US009567036B2

(12) United States Patent
Gallato et al.

(10) Patent No.: US 9,567,036 B2
(45) Date of Patent: Feb. 14, 2017

(54) HULL WITH OPENING IN THE FLOOR FOR A BOAT DRIVE

(71) Applicant: ZF Friedrichshafen AG, Friedrichshafen (DE)

(72) Inventors: Fernando Gallato, Borgoricco (IT); Andrea Tognon, Padua (IT); Stefano Targa, Stra (IT)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 14/438,922

(22) PCT Filed: Oct. 1, 2013

(86) PCT No.: PCT/EP2013/070390

§ 371 (c)(1),
(2) Date: Apr. 28, 2015

(87) PCT Pub. No.: WO2014/072128

PCT Pub. Date: May 15, 2014

(65) Prior Publication Data

US 2015/0298768 A1 Oct. 22, 2015

(30) Foreign Application Priority Data

Nov. 8, 2012 (DE) ..... 10 2012 220 299

(51) Int. Cl.
*B63B 3/38* (2006.01)
*B63B 9/06* (2006.01)
(Continued)

(52) U.S. Cl.
CPC . *B63B 3/38* (2013.01); *B63B 9/06* (2013.01); *B63H 5/125* (2013.01); *B63H 20/02* (2013.01);
(Continued)

(58) Field of Classification Search
CPC ..... B63B 3/38; B63B 9/06
(Continued)

(56) References Cited

U.S. PATENT DOCUMENTS 3,327,675 A * 6/1967 Humphreys ..... B63H 5/125 440/112
3,982,496 A * 9/1976 Blanchard ..... B63H 5/07 440/52
(Continued)

FOREIGN PATENT DOCUMENTS

DE 27 48 276 A1 5/1978
DE 10 2009 000 994 A1 8/2010
(Continued)

OTHER PUBLICATIONS

International Search Report Corresponding to PCT/EP2013/070390 mailed Jan. 28, 2014.
(Continued)

*Primary Examiner* — Lars A Olson
*Assistant Examiner* — Jovon Hayes
(74) *Attorney, Agent, or Firm* — Davis & Bujold, PLLC; Michael J. Bujold

(57) ABSTRACT

A boat hull (1) for a boat, with a boat drive (2) which extends through a hull opening (3) in the bottom of the boat hull (1). The boat drive (2) is connected to the boat hull (1) by at least one fastening member (4). To do this, at least one positioning element (5) is provided, on the outside (6) of the boat hull (1), for positioning the fastening member (4) relative to the boat hull (1).

15 Claims, 2 Drawing Sheets

(51) Int. Cl.
*B63H 5/125* (2006.01)
*B63H 20/02* (2006.01)

(52) U.S. Cl.
CPC .... *B63B 2003/387* (2013.01); *B63H 2020/025* (2013.01)

(58) Field of Classification Search
USPC ..... 440/111–112
See application file for complete search history.

(56) References Cited

U.S. PATENT DOCUMENTS 4,236,478 A * 12/1980 Mansson ..... B63H 21/305 114/269
4,815,996 A * 3/1989 Carr ..... B63H 5/125 440/53
6,206,739 B1 * 3/2001 Dadd ..... B63H 20/14 440/75
7,690,959 B1 * 4/2010 Szilagyi ..... B63B 3/70 440/112
8,740,662 B2 * 6/2014 Gallato ..... B63H 5/125 440/112
2005/0272321 A1 * 12/2005 Mansson ..... B63H 5/07 440/53
2015/0298768 A1 * 10/2015 Gallato ..... B63H 5/125 440/112

FOREIGN PATENT DOCUMENTS

DE 10 2012 210 727 A1 1/2014
WO 2014/000924 A1 1/2014

OTHER PUBLICATIONS

Written Opinion Corresponding to PCT/EP2013/070390 mailed Jan. 28, 2014.

* cited by examiner

HULL WITH OPENING IN THE FLOOR FOR A BOAT DRIVE

This application is National Stage completion of PCT/EP2013/070390 filed Oct. 1, 2013, which claims priority from German patent application serial no. 10 2012 220 299.4 filed Nov. 8, 2012.

FIELD OF THE INVENTION

The invention concerns a boat hull for a boat with a boat drive.

BACKGROUND OF THE INVENTION

Known inboard boat drives have a steering and propulsion unit arranged under the water, which can pivot about a vertical axis. Propulsion is produced by one or two propellers, whose rotational axis can be pivoted by means of a steering unit. By virtue of the ability of the rotational axis to pivot, a steering action for the boat is achieved. For example the boat drive has a vertically arranged column that accommodates the driveshaft for the propeller and which passes through a hull opening in the boat's hull. The driveshaft can be powered by a drive motor arranged inside the hull of the boat. Such boat drives are also known as Pod-Drives.

In the area of the hull opening of such boat drives there is an annular gap around the column. This annular gap is sealed by a sealing arrangement, so that no water makes its way into the boat's hull through the annular gap. For example, DE 2748276 A1 shows a boat hull of a boat, with a boat drive which passes through a hull opening in the bottom of the boat's hull. In this case the annular gap is sealed by an O-ring seal and the boat drive is fixed into the boat's hull by means of flexible fastening means and a motor bed arranged on the inside of the bottom of the boat's hull.

In the manufacture and assembly of the boat's hull, the boat drive and the sealing means, there are necessarily dimensional variations and imprecisions. In the area of the sealing means these dimensional variations and imprecisions result in leaks or to increased stressing of the materials and consequently to a reduction of the life of the components. In addition, inaccurate transitions and gaps can be produced on the outside of the boat's hull, which adversely affect the streamlining of the boat.

SUMMARY OF THE INVENTION

The objective on which the invention is based is achieved by a boat hull and a boat as described below. In addition a method for producing a boat hull is also described.

According to these a boat hull for a boat with a boat drive that passes through a hull opening in the bottom of the boat hull is claimed, wherein the boat drive is connected to the boat hull by at least one fastening means. In this case at least one positioning element is provided on the outside of the boat's hull for positioning the fastening means relative to the hull.

The arrangement of the positioning means on the outside of the boat's hull has the advantage that all other elements of the boat aligned on the positioning element are directly related to the outer hull of the boat. This reduces the production and assembly tolerances or dimensional variations and the individual components can be positioned exactly and reproducibly from the outside. In turn this has the consequence that all components aligned and fixed on the boat's hull in this way will fit one another accurately. For example, in this way a sealing device in the annular gap mentioned earlier can be positioned exactly between the boat drive and the hull of the boat to provide a reliable sealing action, and flexible sealing elements are exposed to reproducible and calculable stressing of the material. In that way the sealing action and the life of such sealing means can be increased. Likewise, any necessary replacement parts can also be positioned simply and accurately at a later time. Parts arranged on the outside of the boat's hull, such as a cover for covering and protecting the sealing device against mechanical damage, can be positioned exactly with the help of the invention, whereby gaps and/or transitions between the cover and the boat's hull that adversely affect the streamlining are avoided and a streamlined outer boat hull surface is produced.

The positioning element on the outside of the boat hull facilitates assembly of the hull, the boat drive and the sealing device and thereby shortens the working time required for assembly.

The fastening means mentioned can for example be pins, bolts, holes, bores, threaded bores or threaded bolts. In a simple embodiment the fastening means consist of threaded bores in the boat's hull, for example in longitudinal or transverse support members of the hull, so that the boat drive is fixed by screws into the threaded bores of the hull. Flexible elements and damping elements between the boat drive and the boat hull, as known from the prior art, can also be part of the fastening means or can be provided additionally.

The positioning element can be of interlocking design. Preferably the positioning element comprises at least one recess and the recess or parts thereof are designed in such manner that they are appropriate for positioning the fastening means relative to the boat hull.

Preferably, the positioning element comprises a contact surface delimited by a reference edge. The reference edge is designed as a stop for positioning the fastening means. The contact surface can be part of the recess with the reference edge forming the boundary of the recess. In this case the reference edge can have the form of a bead, a ledge, a step, a shoulder or an oblique surface, etc. Preferably, the reference edge delimits the contact surface in the plane of the contact surface on all sides, so that on assembly the correct positioning of the components on the hull is ensured.

In a further preferred embodiment the boat hull has a fixing frame for the boat drive, on which the fastening means are arranged. Such a fixing frame can consist entirely or partially of longitudinal support members, also called stringers, or other supporting structures of the boat hull, which are in any case provided for stabilizing the hull of the boat. In that case the fixing frame is preferably made integrally with the boat hull. Integral versions of the boat hull with the fixing frame can for example be made if the fixing frame is laminated onto flat parts of the boat hull, or cast as one piece with the boat hull.

In the case when the fixing frame is first made separately and then joined to the boat hull, the fixing frame is preferably also orientated on the outside of the boat hull relative to the hull with the help of the positioning element. For this, starting from the positioning element on the outside of the boat hull a reference surface is produced on the inside of the hull. The fixing frame is then placed in contact with the reference surface inside the boat hull before being attached or joined to the boat hull. The reference surface provided for the fixing frame on the inside of the hull is preferably positioned parallel to the contact surface on the outside of the hull, mentioned earlier.

In other words a first surface on the outside of the boat's hull is first defined as a positioning element, and starting with this a second surface is defined and produced on the inside of the hull. The boat drive is then fastened to the second surface, exactly in an optimum position relative to the hull.

In addition the present invention includes a boat with a boat hull as described above and with a sealing device for sealing the inside space of the boat, to prevent water from entering in the area of the hull opening. The sealing device is positioned relative to the boat hull by means of the positioning element. In this way, for example, a sealing device can be positioned exactly in the aforesaid annular gap between the boat drive and the boat hull to achieve a reliable sealing action, and flexible sealing elements are exposed to reproducible and calculable material stresses. This improves the sealing effect and extends the life of the sealing device.

A preferred embodiment of the boat according to the invention has a cover, which covers the aforesaid recess of the boat hull on the outside. The cover is positioned relative to the boat hull by means of the positioning element. Components arranged on the outside of the boat hull, such as a cover to cover and protect the sealing device, can also be positioned exactly with the help of the invention, whereby gaps and/or transitions from the edges of the cover to the boat hull, which adversely affect the streamlining, are avoided and a streamlined outer surface of the boat hull is produced. Preferably, such a cover covers the whole of the aforesaid recess, in that its edges are in contact with the reference edge so that a closed, continuously shaped outer surface of the boat hull is produced.

Finally, the present invention includes a method for fitting a boat drive into a boat hull, in particular in order to produce a boat as described above.

The method for producing a boat with a boat drive comprises the following process steps:

a) A boat hull is prepared with a hull opening for a boat drive and with at least one positioning element on the outside of the boat hull, b) A sealing device is prepared, c) The fitting position of the sealing device relative to the boat hull is established with the help of the positioning element, d) The sealing device is fastened to the boat hull, e) Fastening means for the boat drive are prepared, f) The fitting position of the fastening means relative to the boat hull is determined with the help of the positioning element, g) The fastening means are fixed onto the boat hull, h) The boat drive is introduced through the hull opening, and i) The boat drive is fixed to the boat hull by means of the fastening means.

Besides determining the position of the fastening means on the boat hull and fixing it, process step f) can at the same time include determining the position of a fixing frame relative to the boat hull if the fastening means are arranged on a fixing frame which is connected firmly or integrally with the hull. For that purpose a reference surface can be formed on the inside of the boat hull, against which the fixing frame is placed and positioned before it is fixed to the hull. The reference surface is provided during the production of the boat hull in relation to the positioning element arranged on the outside of the boat hull. The reference surface inside the hull is preferably arranged parallel to the contact surface formed on the outside of the hull as the positioning element.

However, the fixing means can also be positioned and fixed directly on the boat hull, and then the hull can already comprise supporting structures such as longitudinal and/or transverse members.

Furthermore, to carry out process steps c) and/or f) it is preferable to use a template to further facilitate exact positioning and in that way further shorten the working time required for assembly.

Preferably the positioning element comprises a recess, which in the subsequent process steps is covered in order to give the boat a streamlined outer contour. A cover for closing the recess on the outside of the boat hull is prepared. Then, the fitting position of the cover is determined with the help of the positioning element and after that the cover is fixed onto the boat hull. With the help of the positioning element on the outside of the hull the correct fitting position of the cover can also be determined simply and reproducibly later on, during the course of maintenance measures.

BRIEF DESCRIPTION OF THE DRAWINGS

The invention will be described in more detail with reference to the embodiment described below and illustrated in the figures, which show.

DETAILED DESCRIPTION OF THE PREFERRED EMBODIMENTS

Figure 1:
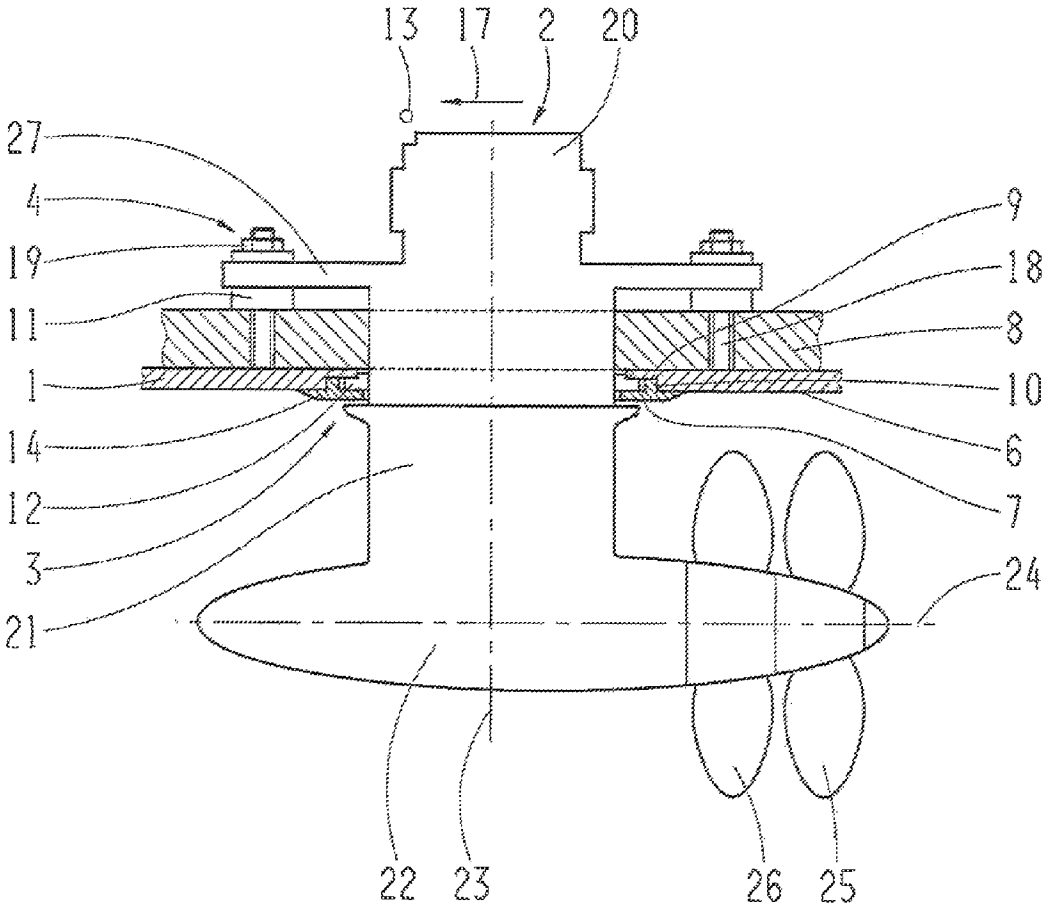
FIG. 1: Part of a boat hull according to the invention with a boat drive, shown as a sectioned view.
Figure 2:
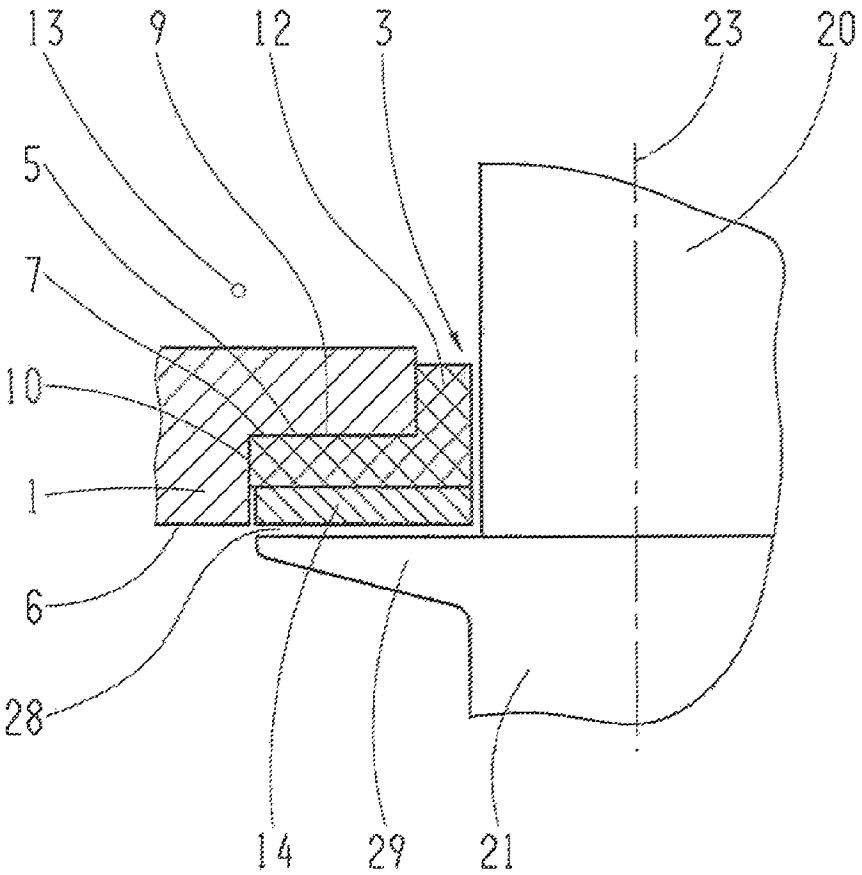
FIG. 2: A section showing the area of the hull opening with another arrangement of the sealing device and the cover, different from that of FIG. 1.

In FIGS. 1 and 2 the same elements are given the same indexes.

The boat hull 1 according to the invention has in its bottom area a hull opening 3. A boat drive 2 extends through the hull opening 3. The boat drive 2 is in the form of a so-termed POD drive. The boat drive 2 comprises essentially a drive motor (not shown) and an upper drive portion 20, both of which are arranged in the interior space 13 of the boat, and also a lower drive portion 21 with a nacelle 22, both being located outside the boat hull 1. The upper drive portion 20 is fixed in the boat hull 1 by fastening means 4. In the area of the hull opening 3 the upper portion 20 is connected to the lower drive portion 21 in such manner that it can pivot. Outside the boat hull 1, the nacelle 22 is arranged at the lower end of the lower drive portion 21. The lower drive portion 21, together with the nacelle 22, can be pivoted about a substantially vertical axis 23 by means of a steering unit. At its rear end relative to the travel direction 17, the nacelle 22 has two propellers 25 and 26, which can be driven in rotation about a rotational axis 24 arranged essentially horizontally, i.e. parallel to the surface of the water.

By virtue of the ability of the nacelle 22 with its propellers 25 and 26 to pivot, a steering angle is established for the boat. Through the inside of the upper and lower drive portions 20 and 21 there extends a drive-train (not shown) for the propellers 25 and 26. The drive-train consists essentially of driveshafts driven by a drive motor and bevel gears for transmitting the rotational movements to a propeller shaft lying in the travel direction 17, to which shaft the propellers 25 and 26 are attached.

The boat drive 2 is connected to the boat hull 1 by a number of fastening means 4. In this example embodiment the fastening means are in the form of threaded bolts 18 with hexagonal nuts 19. Advantageously, the fastening means 4 comprise additional securing elements for the screw connection between the hexagonal nuts 19 and the threaded bolts 18, for example retaining rings or locking nuts. In this example embodiment the fastening means 4 also comprise damping means 11 made from a flexible material such as rubber, with the help of which the boat drive 2 is connected to the boat hull 1 with vibration damping. In this way vibrations and impacts, for example caused by the drive motor, are not transmitted from the boat drive 2 to the boat hull 1 without damping, so that undesired noise emission and vibrations through the boat hull 1 are avoided or at least substantially reduced.

On its outside 6, the boat hull 1 has a positioning element 5 for positioning the fastening means 4 relative to the hull 1. The positioning element 5 is in the form of a recess 7. In the area of the hull opening 3 the recess 7 extends all the way round the hull opening 3 and, for example, is of circular shape corresponding to the hull opening 3. In this case the transition from the flat surface of the outside 6 of the boat hull 1 to the recess 7 is in the form of a step which forms a reference edge 10 perpendicular to the outer surface 6.

A sealing device 12 is at least partially arranged in the recess 7. The purpose of the sealing device 12 is to seal the annular gap between the hull opening 3 and the boat drive 2 passing through it. The sealing device 12 is intended to prevent water from making its way from outside the boat hull 1 to the inside space 13 of the boat. Various such sealing devices have already been described, for example in the documents DE 102009000994 A1 and DE 102012210727 A1.

The positioning element in the form of the recess 7 can be used both for positioning the fastening means 4 and also for positioning a sealing device 12 and a cover 14 arranged in the area of the hull opening 3.

In the embodiments shown the positioning element 5 in the form of a recess 7 consists of a contact surface 9 and a reference edge 10. To position the fastening means 4, the sealing arrangement 12 and the cover 14 exactly, these elements are placed in contact either with the contact surface 9, or the reference edge 10, or both, before being fixed to the hull 1 of the boat.

In the embodiment according to FIG. 1, the sealing device 12 is in contact with the contact surface 9 and with an inner rim of the hull opening 3, and its position is therefore fixed relative to the boat hull 1. In this embodiment the cover 14 is in contact both with the contact surface 9 and with the reference edge 10, and is therefore positioned relative to the boat hull 1.

In the embodiment according to FIG. 2, the sealing device 12 is against the contact surface 9 and the reference edge 10, and its position relative to the boat hull 1 is therefore defined. In this embodiment, the cover 14 is over the sealing device 12 and is completely countersunk into the recess 7, so that there is a smooth, streamlined transition between the outside 6 of the boat hull 1 and the outer surface of the cover 14.

Particularly for positioning the fastening means 4 in the inside space 13 of the boat, it can be advantageous to use a template, which is also placed in contact with the contact surface 9 and/or the reference edge 10 before the fastening means 4 are fitted in and attached to the boat hull 1.

At its upper end the lower drive portion 21 has a projection 29, which covers the hull opening 3 and the components arranged therein, such as the cover 14 and the sealing device 12, so protecting them from mechanical damage. Between the projection 29 and the outside 6 of the boat hull 1 or cover 14 there is necessarily a gap 28 since the projection, together with the lower drive portion 21, can pivot relative to the boat hull 1. The gap 28 is advantageously made as narrow as possible, because in that area this gives the boat a more streamlined design and the risk that objects floating in the water could get into the gap and damage components of the boat is smaller. The design of the boat hull 1 with the reference element 5 in the form of the recess 7 on the outside of the boat hull 1 enables the boat to be made with a very narrow gap 28, because the components—the boat drive 2 and the cover 14—that form the gap are directly over the reference element 5 in a form-enclosing configuration and can therefore be fixed exactly in the positions intended for them. Tolerance deviations in the production of the individual components and during the assembly of the boat are thereby minimized.

The narrow gap that can be achieved by virtue of close tolerances and the precise positioning of the boat drive 2 in the boat hull 1 results in streamlined hydrodynamics and increased propeller performance when moving the boat through water.

With the help of holding arms 27, a housing of the boat drive 2 is attached to the inside of the boat hull 1 or to the fixing frame 8. By appropriate selection of the material for and the shape of the holding arms 27, they can be designed so that in addition or alternatively to the damping means 11, they damp oscillations and vibrations between the boat drive 2 and the boat hull 1. The holding arms 27 can be made integrally with the housing of the boat drive 2 or integrally with the housing of the upper drive portion 20.

INDEXES

1 Boat hull
2 Boat drive
3 Hull opening
4 Fastening means
5 Positioning element
6 Outer side
7 Recess
8 Fixing frame
9 Contact surface
10 Reference edge
11 Damping means
12 Sealing device
13 Inside space of the boat
14 Cover
15 Reference surface
16 Threaded bore
17 Travel direction
18 Threaded bolt
19 Hexagonal nut
20 Upper portion of the drive
21 Lower portion of the drive
22 Nacelle
23 Pivoting axis
24 Rotational axis
25 Propeller
26 Propeller
27 Holding arm
28 Gap
29 Projection

The invention claimed is:

1. A boat comprising:

a boat hull (1) having a hull opening that extends through the boat hull, a boat drive (2) extending through the hull opening (3) in a bottom of the boat hull (1), and the boat drive (2) being connected to the boat hull (1) by at least one fastening means (4), at least one annular recess being located in an exterior side of the boat hull and bordering the hull opening, either the recess (7) or parts thereof forming a positioning element and being designed so as to be suitable for positioning the fastening means (4) relative to the boat hull (1), a sealing device (12), for sealing an inside space (13) of the boat against entry of water, is arranged in an area of the hull opening (3), the recess (7) being covered on the exterior side of the boat hull by a cover (14), and the sealing device (12) and the cover (14) are positioned relative to the boat hull (1) by means of the recess.

2. The boat according to claim 1, wherein the recess is defined by a contact surface (9), and the contact surface (9) is radially delimited by a reference edge (10) which forms a stop for positioning the fastening means (4).

3. The boat according to claim 2, wherein the reference edge (10) delimits a radially outer side of the contact surface (9) in a plane of the contact surface.

4. The boat according to claim 1, wherein the boat hull comprises a fixing frame (8) which connects the boat drive (2) to the boat hull, and the fastening means (4) are arranged on the fixing frame (8).

5. The boat according to claim 4, wherein the fixing frame (8) is made integrally with the boat hull (1).

6. The boat according to claim 4, wherein an interior side of the boat hull has a reference surface (15) for positioning the fixing frame (8).

7. The boat according to claim 1, wherein the fastening means (4) include at least one of at least one threaded bore (16) and at least one threaded bolt.

8. A method of producing a boat with a boat drive, the method comprising the steps of:

preparing a boat hull (1) with a hull opening (3) for a boat drive (2) and with at least one annular recess, the hull opening extending through the boat hull and recess being prepared in an exterior side of the boat hull (1) and bordering the hull opening, preparing a sealing device (12), establishing a fitting position of the sealing device (12) relative to the boat hull (1) with the recess, fastening the sealing device (12) to the boat hull (1) such that the sealing device is partially located within the recess and partially located within the hull opening, preparing fastening means (4) for the boat drive (2), determining a fitting position of the fastening means (4) relative to the boat hull (1) with the recess, fixing the fastening means (4) to the boat hull (1), introducing the boat drive (2) through the hull opening (3), fixing the boat drive (2) to the boat hull (1) by the fastening means (4), preparing a cover (14) for closing the recess (7) on the exterior side the boat hull (1), determining a fitting position of the cover (14) with the recess, and fixing the cover (14) onto the boat hull (1).

9. The method according to claim 8, further comprising the step of using a template to at least one of establish the fitting position of the sealing device (12) and determine the fitting position of the fastening means (4).

10. A boat comprising:

a boat hull (1) having a hull opening that extends through the boat hull, a boat drive (2) extending through the hull opening (3) from an interior side of the boat to an exterior side of the boat, and the boat drive (2) being connected to the boat hull (1) by at least a pair of fasteners (4), at least one annular recess being provided in the boat hull on an outer side thereof, the at least one recess encircles and borders the hull opening, and the at least one recess facilitates positioning of the fasteners (4) relative to the boat hull (1), a sealing device (12), for sealing the interior side of the boat against entry of water, is arranged in the hull opening (3), and a portion of the sealing device extends radially into the recess from the hull opening, a cover (14) being at least partially received within the recess, and the sealing device (12) and the cover (14) are positioned relative to the boat hull (1) by means of the recess such that the sealing device is sandwiched between the boat hull and the sealing device.

11. The boat according to claim 10, wherein the boat hull has an interior surface and an exterior surface, and the recess in the boat hull defines a first surface, that extends radially from the hull opening, and a second surface that extends normal from the first surface to the exterior surface of the boat hull.

12. The boat according to claim 11, wherein an inner face of the sealing element contacts the first surface of the boat hull and an outer face of the sealing element contacts a surface of the cover.

13. The boat according to claim 11, wherein the boat hull has a thickness, and the thickness of the boat hull, between the interior surface and the first surface, is less than the thickness of the boat hull between the interior surface and the exterior surface.

14. The boat according to claim 11, wherein a portion of the sealing device extends within the hull opening between the boat hull and the boat drive.

15. The boat according to claim 14, wherein the sealing device abuts the boat hull.

* * * * *